United States Patent [19]

Itoh et al.

[11] Patent Number: 4,741,293

[45] Date of Patent: May 3, 1988

[54] ENGINE COOLING STRUCTURE

[75] Inventors: Toshinobu Itoh; Hiroichi Takubo; Kazuaki Nishimura, all of Hiroshima, Japan

[73] Assignee: Mazda Motor Corporation, Hiroshima, Japan

[21] Appl. No.: 917,076

[22] Filed: Oct. 8, 1986

[30] Foreign Application Priority Data

Oct. 9, 1985 [JP] Japan ..... 60-153674[U]
Dec. 16, 1985 [JP] Japan ..... 60-193696[U]

[51] Int. Cl.[4] ..... F02F 1/14; F01P 5/10

[52] U.S. Cl. ..... 123/41.79; 123/41.44; 123/41.74

[58] Field of Search ..... 123/41.44, 41.74, 41.79

[56] References Cited

U.S. PATENT DOCUMENTS 1,791,572 2/1931 Ornberg ..... 123/41.44
4,413,596 11/1983 Hirayama ..... 123/41.44

*Primary Examiner*—Allen M. Ostrager
*Attorney, Agent, or Firm*—Wegner & Bretschneider

[57] ABSTRACT

In an engine cooling structure in which a water pump for causing a cooling water or coolant to flow in a watercool engine is located at or near one end portion of a cylinder block in the direction of the cylinder alignment, coolant passages include a main coolant passage disposed in a cylinder head and the cylinder block, a radiator circulating passage leading the cooling water from the water pump through an engine body to a radiator core, a by-pass passage by-passing the radiator core, and a heater circulating passage leading the cooling water from the engine body to an air-conditioning heater. The radiator circulating passage and the by-pass passage are arranged so as to switch by a thermostat valve. The by-pass passage and/or the heater circulating passage are or is constructed so as to have a coolant return passage disposed in the cylinder block extending in the direction of the cylinder alignment.

9 Claims, 7 Drawing Sheets

ENGINE COOLING STRUCTURE

BACKGROUND OF THE INVENTION

1. Field of the invention

The present invention relates to an improvement in the cooling structure of a watercool engine and, more particularly, to an engine cooling structure in which a water pump causing to flow a cooling water for cooling an engine is located at or near one end portion of a cylinder block and positioned in the direction of the cylinder alignment.

2. Description of Prior Art

A watercool engine generally includes a water pump for causing a water for cooling an engine to flow, which is located at or near one end portion of an engine body in the direction of the cylinder alignment and which causes the cooling water or coolant pumped therefrom to flow from the one end portion of the engine body to a water jacket in the engine body.

Passages through which the cooling water passes include a main coolant passage leading the cooling water from the water pump outlet to the cylinder block and a cylinder head, a radiator circulating passage circulating the cooling water led to the main coolant passage through a radiator core and then leading it to the inlet portion of the water pump, a by-pass passage bypassing the cooling water led to the main coolant passage disposed in the cylinder head from the radiator core and leading it to the inlet portion of the water pump, and a heater circulating passage circulating a portion of the cooling water led to the main coolant passage through an air-conditioning heater and leading it to the inlet portion of the water pump. Among the passages, the by-pass passage and the radiator circulating passage are constructed so as to be opened or closed by a thermostat valve that senses temperatures of the cooling water. This arrangement is disclosed in Japanese Patent Publication No. 29,248/1980.

U.S. Pat. No. 3,636,935 discloses a structure of coolant passages in which a by-pass passage connecting a main coolant passage disposed in the cylinder head to the inlet portion of the water pump and a return passage connecting an air-conditioning heater mounted on the heater circulating passage to the inlet poriton of the water pump are formed each of a long length of a pipe mounted outside the engine body. Accordingly, an early deterioration in pipes is caused to occur due to radiant heat from an exhaust manifold if the pipes are mounted on the side of the exhaust system of an engine. And this arrangement makes a layout of parts around the engine body complicated and difficult so that the assembly of the engine body is rendered laborious. Furthermore, pipes are required to be bent into complex shapes and a resistance to flow in passages becomes high.

SUMMARY OF THE INVENTION

The present invention has an object to provide an engine cooling structure in which improvements are made in arrangements for a by-pass passage connecting the main coolant passage disposed in a cylinder head to the inlet portion of a water pump and a return passage connecting the heater mounted on the heater circulating passage to the inlet portion of the water pump, thereby rendering a layout of parts around the engine body easy and minimizing a resistance to flow in coolant passages.

The present invention has another object to provide an engine cooling structure in which improvements are made in arrangements for a by-pass passage connecting the main coolant passage disposed in a cylinder head to the inlet portion of a water pump and a return passage connecting the heater mounted on the heater circulating passage to the inlet, portion of the water pump, thereby enhancing a rigidity of a support for a skirt of a cylinder block.

The present invention is fundamentally constituted by the structure in which at least either of the by-pass passage and the heater circulating passage includes a coolant return passage disposed in the cylinder block and extending in the direction of the cylinder alignment. This arrangement does not require pipes for the by-pass passage and/or the return passage in the heater circulating passage to be mounted outside the engine body, thereby rendering a layout of parts around the engine body easy. Furthermore, this arrangement does not require pipes of complicated shapes so that an increase in a resistance to flow in the passages can be minimized. This structure also has the advantage that damages against the coolant passages on account of radiant heat from the exhaust system can be prevented.

In accordance with the present invention, it is preferred that both of the by-pass passage and the heater circulating passage are disposed so as to have the respective return passages mounted in the cylinder block. It is further preferred that these return passages disposed in the cylinder block are positioned in parallel to each other. This structure is particularly effective when it is applied to a so-called transversal-situated engine that is disposed so as to cause the direction of its cylinder alignment to be perpendicular to the front-to-rear direction of the vehicle body. The effects and advantages will become more remarkable in this case.

In order to simplify a layout of parts around the engine body, it is desired that the cylinder block is provided within it with a hollow portion for mounting a thermostat valve and/or a water pump housing for receiving an impeller of the water pump. In this case, it is more preferred that the thermostat valve mounting hollow portion and the water pump housing are arranged so as to communicate with a coolant passage disposed in the cylinder block, thereby reducing the number of pipes and laborious work for connecting pipes outside the engine body.

In instances where the by-pass passage includes the coolant return passage disposed in the cylinder block, it is preferred that one end of the coolant return passage is mounted so as to have an opening on the bottom portion of the thermostat valve mounting hollow portion. With this arrangement, the opening portion of the coolant return passage can function directly as a valve seat for the thermostat valve.

In instances where the heater circulating passage includes the coolant return passage disposed in the cylinder block, it is preferred that the cylinder block is provided therein with the water pump housing for receiving the impeller of the water pump and furthermore that the return passage is mounted virtually concentrically with the axis of the impeller of the water pump. This structure can decrease a resistance to flow in the heater circulating passage and enables to raise the heater efficiency in the cold.

Furthermore, in instances where the by-pass passage includes the coolant return passage disposed in the cylinder block, it is preferred that the coolant return passage is mounted in the lower deck of the cylinder block so as to be positioned symmetrically with an oil passage for a lubricating oil disposed in the lower deck of the cylinder block with respect to the center line of the cylinder bore. This structure can provide the cylinder block with a balance between the coolant return passage disposed in the cylinder block and the oil passage, thereby enhancing a rigidity of a support for a skirt portion of the cylinder block. This structure can also make the rigidity in the lower deck virtually uniform in the direction of the cylinder alignment so that the rigidity in the cylinder block is also enhanced without an increase in the engine weight. As a result, a vibration in the skirt portion of the cylinder block can be decreased effectively. Furthermore, it is preferably possible to mount an oil return passage adjacent the coolant return passage disposed in the cylinder block, whereby the lubricating oil is warmed up in the cold within short.

BRIEF DESCRIPTION OF DRAWINGS

FIG. 1 is a diagrammatic fragmentary plan view illustrating an outline of the whole structure of the engine cooling apparatus according to the present invention.

FIG. 2 is a diagrammatic fragmentary side view illustrating an outline of the whole structure of the engine cooling apparatus according to the present invention.

FIG. 3 is a partially cut-away front view illustrating a by-pass passage in accordance with the present invention.

FIG. 4 is a cross sectional view, taken along the line IV—IV in FIG. 3.

FIG. 5 is a cross sectional view illustrating the thermostat valve and the connection of the cylinder block to the radiator.

FIG. 6 is a diagrammatic plan view illustrating the whole cooling system of the engine cooling structure.

FIG. 7 is a partially cut-away plan view illustrating the by-pass passage.

FIG. 8 is a front view of the lower deck of the cylinder block.

FIG. 9 is a cross sectional view, taken along the line IX—IX in FIG. 8.

FIG. 10 is a partially cross sectional view, taken along the line X—X in FIG. 8.

DETAILED DESCRIPTION OF THE PREFERRED EMBODIMENT

FIGS. 1 through 5 described the first embodiment of the engine cooling apparatus in accordance with the present invention. The present invention will be described by referring to the engine cooling apparatus that is applied to an engine of a watercool, transversal-situated in-line four cylinder type.

Figure 1:
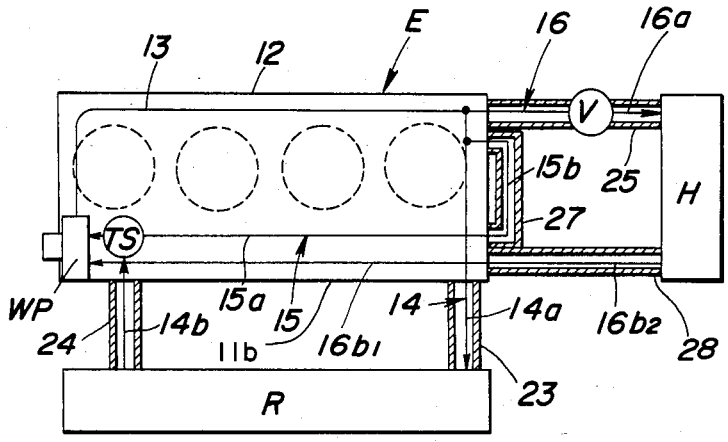
FIGS. 1 through 5 illustrate the first embodiment of the engine cooling structure in accordance with the present invention.
Figure 2:
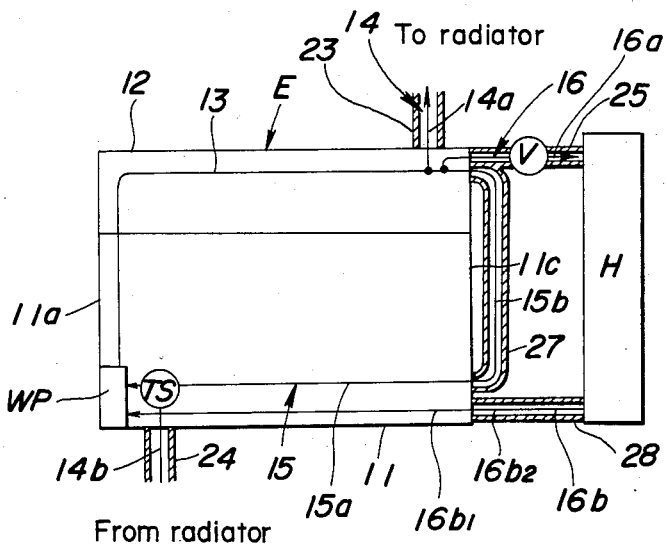

Referring to FIGS. 1 and 2, the engine cooling apparatus includes a water pump WP, a main coolant passage 13, a radiator circulating passage 14, a coolant by-pass passage 15, a heater circulating passage 16, and a thermostat valve TS. The water pump WP is mounted on one end portion 11*a* of the cylinder block 11 in the direction of the cylinder alignment. The main coolant passage 13 extends from the outlet portion of the water pump WP and is disposed in the cylinder block 11 and a cylinder head 12. The main coolant passage 13 disposed in the cylinder head 12 is then connected separately to the radiator circulating passage 14 and the heater circulating passage 16. The radiator circulating passage 14 is circulated through a radiator core R to the inlet portion of the water pump WP. The heater circulating passage 16 is circulated through a valve V and a heater H to the inlet portion of the water pump WP. The coolant by-pass passage 15 connected to the main coolant passage 13 is mounted so as to by-pass the radiator core R and circulated to the inlet portion of the water pump WP. The thermostat valve TS is mounted as a valve for sensing temperatures of the cooling water circulated from the by-pass passage 15 so as to sense temperatures of the cooling water circulated therefrom and to open or close the radiator circulating passage 14 in accordance with the temperature sensed thereby.

Figure 3:
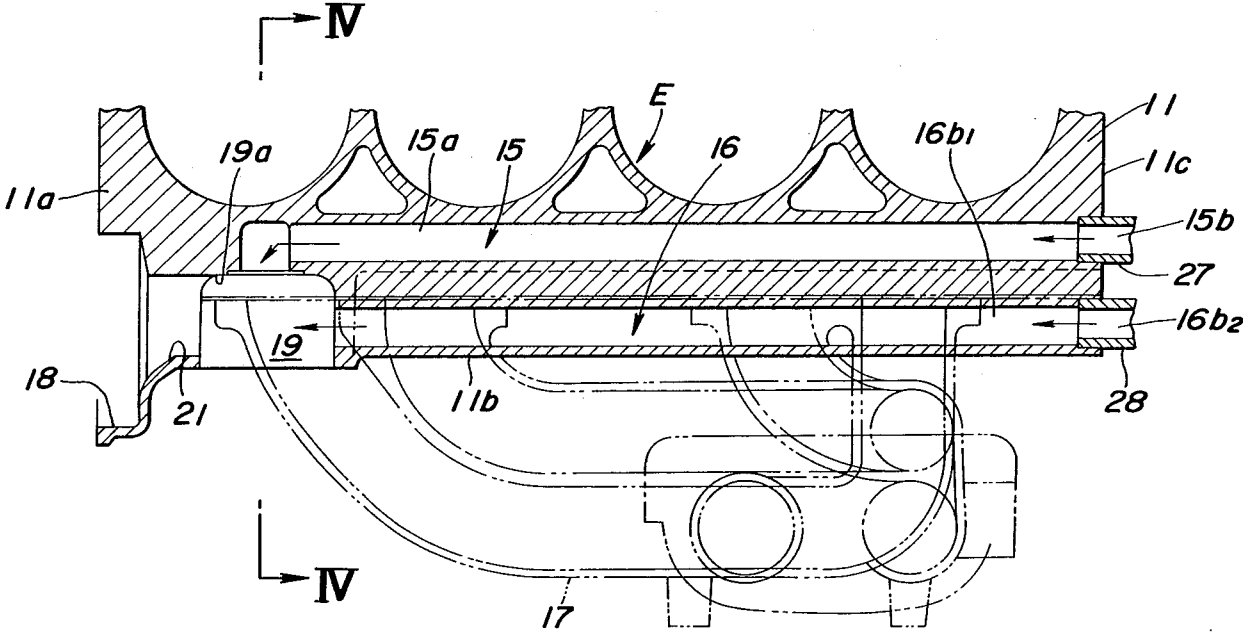
Figure 4:
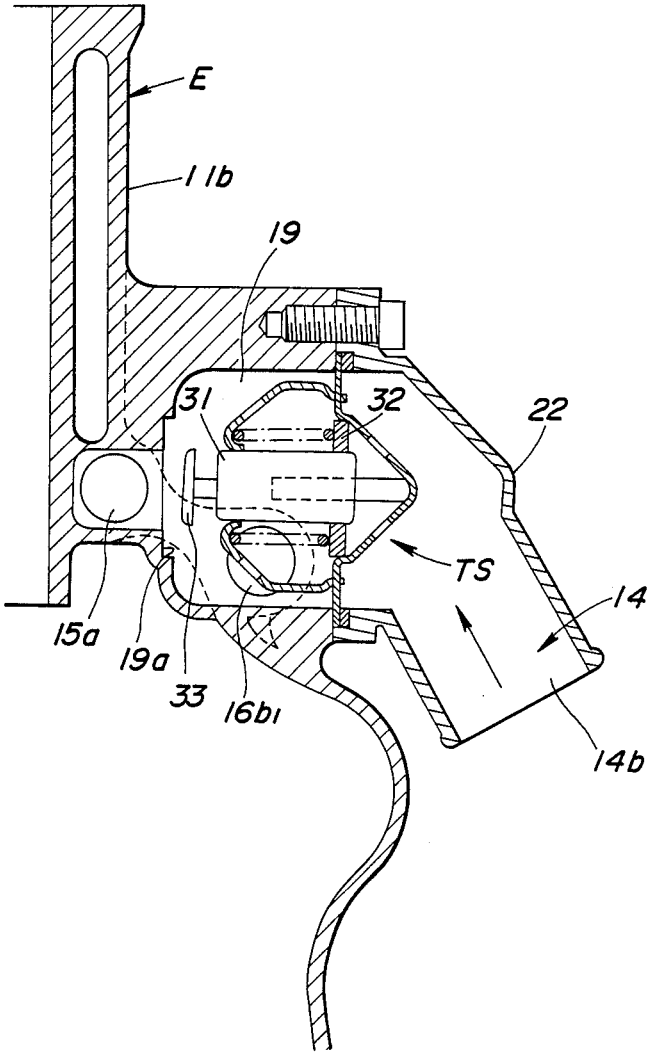
Figure 5:
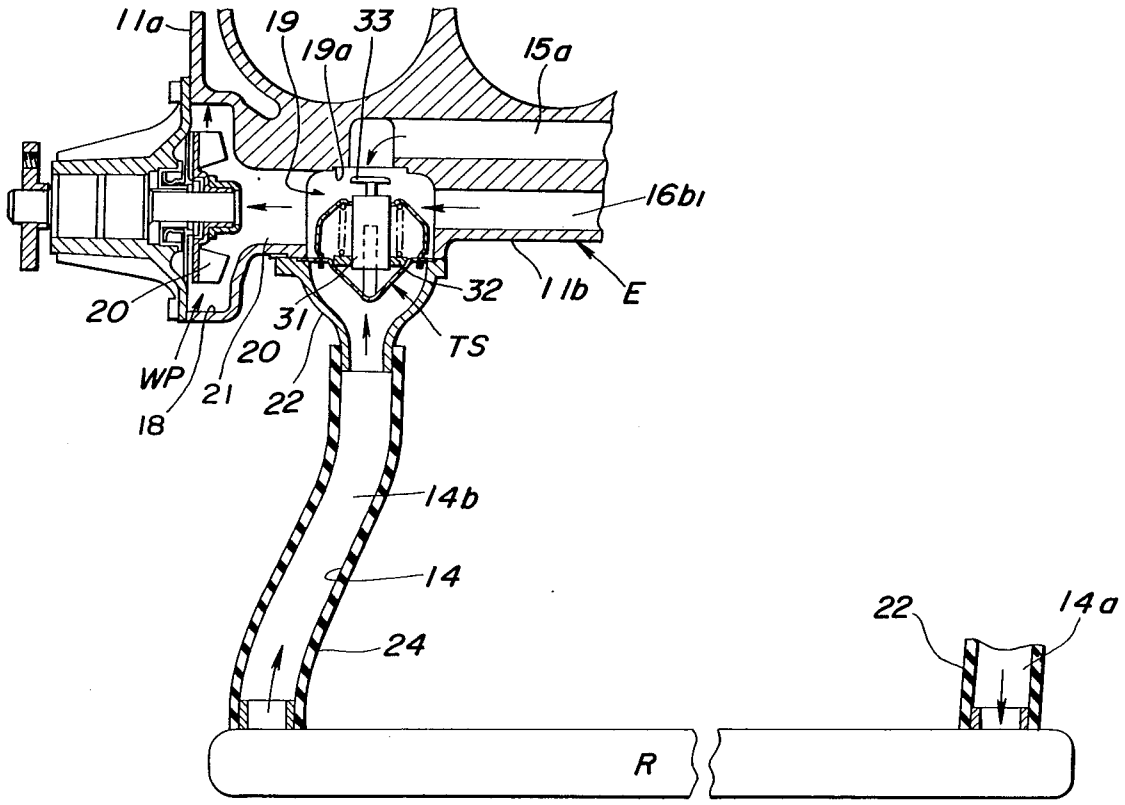
Figure 6:
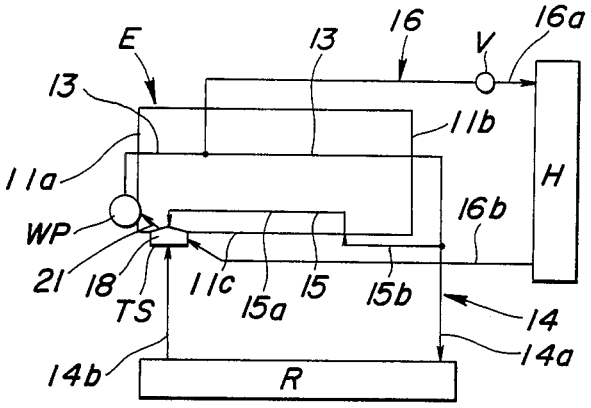
FIGS. 6 through 10 illustrate the second embodiment of the engine cooling structure in accordance with the present invention.

As shown in FIG. 5, the water pump WP is mounted on one end portion 11*a* of the cylinder block 11 and on one side 11*b* (front of the vehicle body) on which an exhaust manifold 17 is mounted as shown in FIG. 3. The thermostat valve TS is mounted adjacent the water pump WP and on the side of the cylinder block 11 on which the exhaust manifold 17 is mounted, as shown in FIGS. 4 and 5. As shown in FIGS. 3 and 5, one end portion 11*a* of the cylinder block 11 at the corner of the side on which the exhaust manifold 17 is mounted is provided with a water pump housing 18 with an opening at the one end surface of the cylinder block 11. Near the water pump housing 18 is formed a hollow portion 19 with an opening at one side surface 11*b* of the cylinder block 11 on which the exhaust manifold is mounted for receiving the thermostat valve TS. As shown in FIG. 5, the water pump housing 18 mounts an impeller 20 for the water pump WP, and the hollow portion 19 for the receipt of the thermostat valve TS is connected to the water pump housing 18 through a through passage 21 formed in the cylinder block 11.

The radiator circulating passage 14 includes a radiator inlet passage 14*a* and a radiator outlet passage 14*b*. The radiator inlet passage 14*a* connects the main coolant passage 13 disposed in the cylinder head 12 to the radiator core R, and the radiator outlet passage 14*b* connects the radiator core R to a valve casing 22 for the thermostat valve TS.

Turning now to FIGS. 3, 4 and 5, the heater circulating passage 16 includes a heater inlet passage 16*a* connecting the main coolant passage 13 in the cylinder head 12 to the heater 11 and a heater outlet passage 16*b* connecting the heater H to the inlet portion of the water pump WP. The heater inlet passage 16*a* is formed of a pipe 25 and mounts the valve V, and the heater outlet passage 16*b* is formed of a pipe 28.

The by-pass passage 15 includes a coolant return passage 15*a* disposed in the cylinder block 11 on the side on which the exhaust manifold 17 is mounted. The coolant return passage 15*a* extends in the direction of the cylinder alignment. To the heater outlet passage 16*b* of the heater circulating passage 16 is connected a coolant return passage 16*b*1 disposed on the side of the cylinder block 11 on which the exhaust manifold 17 is mounted and extending in the direction of the cylinder alignment.

As shown in FIGS. 3 through 5, the coolant return passage 15a disposed in the cylinder block 11 is provided on one end thereof with an opening on the bottom surface 19a in the hollow portion 19 in which the thermostat valve TS is mounted. The other end of the coolant return passage 15a also has an opening on the other end surface 11c of the cylinder block 11, as shown in FIG. 3, and is connected to the coupling by-pass passage 15b that in turn is connected to the main coolant passage 13 disposed in the cylinder head 12. In the embodiment shown in FIGS. 2 and 3, the coupling by-pass passage 15b is formed of a pipe 27 mounted outside the engine E; however, it may also be disposed in the cylinder block 11.

Turning now to FIGS. 1 through 3, the heater outlet passage 16b connected to the heater H is mounted on the one side of the cylinder block 11 on which the exhaust manifold 17 is mounted, and it includes a coolant return passage 16b1 disposed in the cylinder block 11 has at its one end an opening on the bottom surface 19a of the hollow portion 19 for mounting the thermostat valve TS and extending in the direction of the cylinder alignment. The coolant return passage 16b1 is positioned in parallel to the coolant return passage 15a of the by-pass passage 15 and substantially concentric with the axis center of the impeller 20 of the water pump WP. This arrangement may minimize a resistance to the passage between the coolant return passage 16b1 and the water pump WP to the possibly maximum level and consequently enhance the heater efficiency during the engine E is in the cold state. The other end of the coolant return passage 16b1 is connected to the heater H through a coupling passage 16b2 formed of a pipe 28.

As shown in FIGS. 4 and 5, the wax-type thermostat valve TS includes a main valve 32 for operating the opening or closing of the radiator outlet passage 14b in accordance with the temperature sensed by a temperature sensing portion 31, and a by-pass valve 33 positioned opposite the main valve 32 across the temperature sensing portion 31 for operating the closure of the coolant return passage 15a of the by-pass passage 15. The thermostat valve TS is mounted so as to allow the by-pass valve 33 to face the bottom surface 19a of the hollow portion 19. More specifically, the by-pass valve 33 is mounted so as to face the opening for the coolant return passage 15a of the by-pass passage 15. The thermostat valve TS may constitute a valve structure for opening or closing the by-pass passage 15 merely by mounting it in the hollow portion 19 for receiving the thermostat valve TS.

In the cooling structure of the engine with the above-described arrangement, when the cooling water is not caused to be warm enough, the radiator outlet passage 14b in the radiator circulating passage 14 is closed by the thermostat valve TS so that the cooling water passed through the main coolant passage 13 disposed in the cylinder head 12 is returned to the water pump WP through the by-pass passage 15. This may prevent the cooling water from being supercooled by the radiator core R and consequently the engine E from being supercooled by the cooling water.

When the temperature of the cooling water is caused to be above a predetermined value, for example, 80 C, the radiator outlet passage 14b of the radiator circulating passage 14 is opened by the operation of the thermostat valve TS so that the cooling water passed through the main coolant passage 13 disposed in the cylinder head 12 is cooled through the radiator core R and then returned through the thermostat valve TS to the inlet portion of the water pump WP, thereby enabling the cooling water to be maintained at optimum temperatures.

The engine cooling structure with the arrangement as described hereinabove includes the coolant return passage 15a in the by-pass passage 15 and the coolant return passage 16b1 in the heater circulating passage 16 which are mounted each in the wall on the side of the exhaust system of the cylinder block 11 extending in the direction of the cylinder alignment so that it is not necessary to mount a long length of pipes for coolant passages along the side wall of the exhaust system outside the engine E. This arrangement accordingly enables a layout of parts around the engine body to be rendered simple. Further, in this arrangement, the coolant return passage 15a and the coolant return passage 16b1 are designed so as to be in the straight form so that a resistance within the passage is decreased and furthermore prevent an early deterioration due to heat damages.

FIGS. 6 through 10 illustrate the second embodiment of the engine cooling apparatus in accordance with the present invention. In the figures like reference numerals refer to identical or similar features of the invention. The following description will be made mainly on the characteristic features of the second embodiment without describing the elements referred to by the identical reference numerals.

The heater outlet passage 16b of the heater circulating passage 16 is formed of a pipe 40 that connects the heater H to the inlet portion of the water pump WP.

Figure 8:
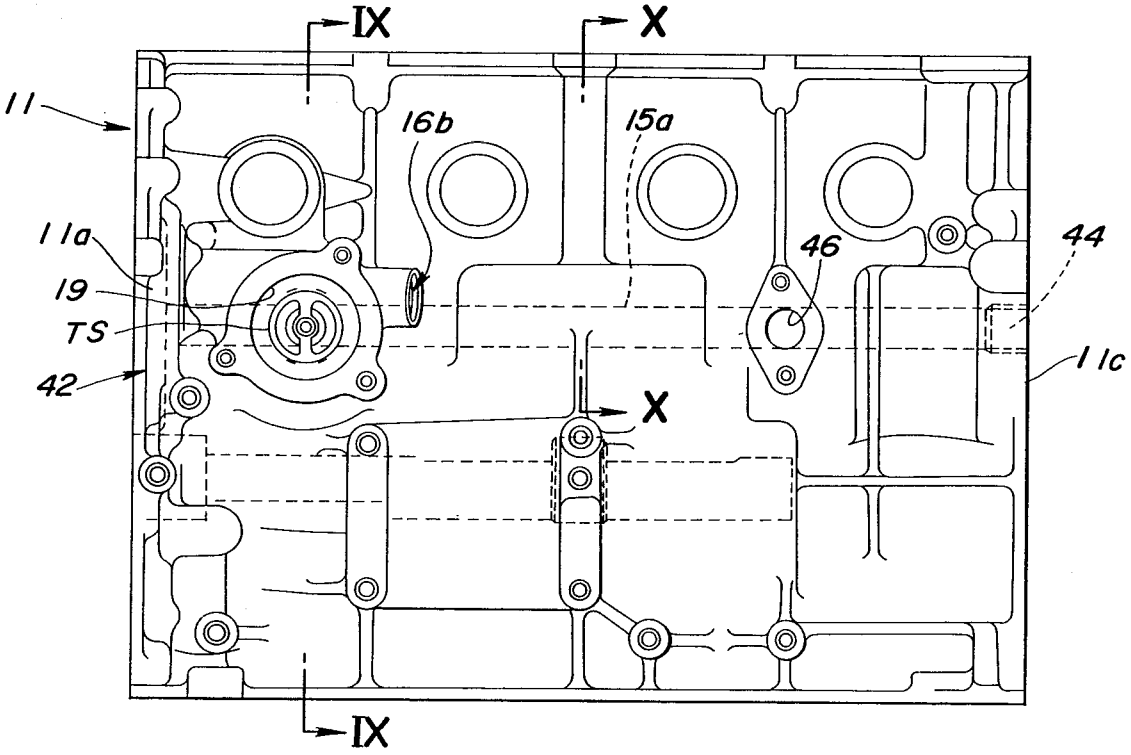
Figure 9:
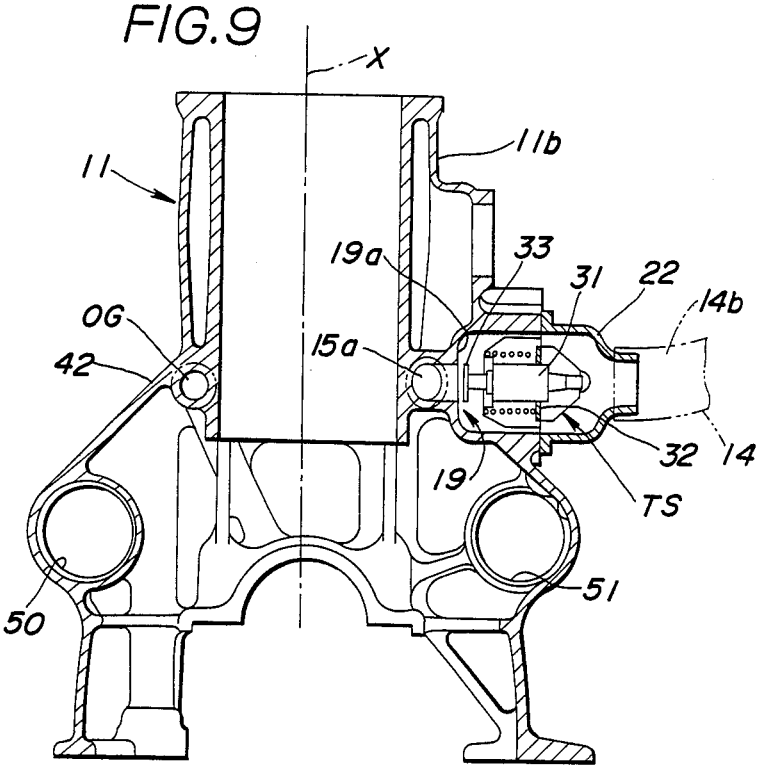

The by-pass passage 15 includes the coolant return passage 15a disposed in the cylinder block 11 and mounted on the side of the lower deck 42 of the cylinder block 11 on which the exhaust manifold 17 is mounted, as shown in FIGS. 8 and 9. The lower deck 42 of the cylinder block 11 mounts a main oil gallery OG opposite the coolant return passage 15a disposed in the cylinder block 11 and extending in the direction of the cylinder alignment as the coolant return passage 15a is so as to allow the main oil gallery OG and the coolant return passage 15a to be positioned substantially symmetric when seen from the direction of the cylinder alignment, as shown in FIG. 9. That is, the coolant return passage 15a disposed in the cylinder block 11 is provided so as to be positioned virtually symmetrically with the main oil gallery OG with respect to the center line X of the cylinder bore in the foot portion of the skirt. This structural arrangement is useful and effective in terms of a vibration prevention and a flexural rigidity.

Figure 7:
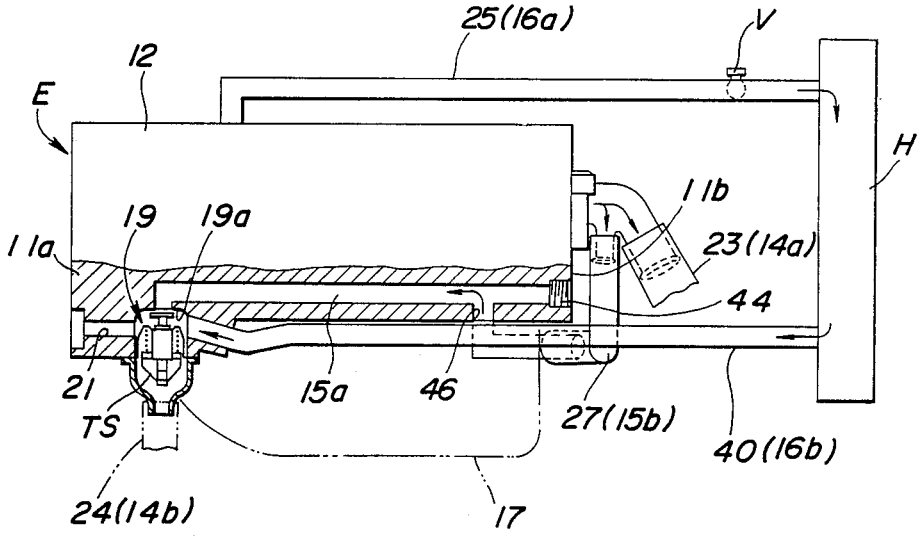

As shown in FIG. 8, the other end of the coolant return passage 15a disposed in the cylinder block 11 is closed by a screw plug 44 on the other side end surface 11c of the cylinder block 11. Accordingly, as shown in FIG. 7, the coolant return passage 15a branches off and is connected to the pipe 27 through an entrance 46 with an opening provided on the side surface 11b of the cylinder block 11, thereby enabling the cooling water to be led to the coolant return passage 15a disposed in the cylinder block 11.

Figure 10:
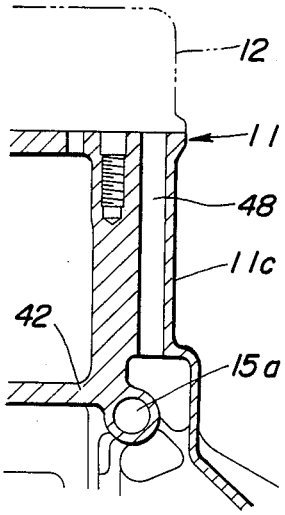

In the cylinder block 11 is mounted an oil return passage 48 for returning a lubricating oil from a cam chamber in the cylinder head 12 to an oil pan (not shown) in the middle of the direction of the cylinder alignment on the side of the exhaust system 17, extending in the up-and-down direction. The oil return passage 48 is mounted, as shown in FIG. 10, across the tubular wall from the coolant return passage 15a of the by-pass passage 15 disposed in the cylinder block 11 and extending in the cross direction therefrom. In other words, the oil return passage 48 leading from the cylinder head 12 to the oil pan is crossing adjacent the coolant return passage 15*a* of the by-pass passage 15 so that the cooling water passing through the by-pass passage 15 can warm the lubricating oil at the start-up time during the engine is cold, thereby shortening the start-up period. As shown in FIG. 9, the numerals 50 and 51 are each a space for receiving a balancer shaft extending in the direction of the cylinder alignment, and the balancer shaft receiving spaces 50 and 51 mount each a balancer shaft (not shown) that can offset the vibration of a crank shaft (not shown).

While the preferred embodiments have been described in detail, it should be understood that the present invention is not limited thereto and modifications and alterations can be made thereto without departing from the spirit of the invention.

What is claimed:

1. An engine cooling structure comprising:

a water pump located at or near one end portion of an engine body in the direction of the cylinder alignment;

a radiator circulating passage for circulating a cooling water led from the outlet portion of a water pump into a main coolant passage disposed in a cylinder block and a cylinder head through a radiator and leading it to the inlet portion of the water pump;

a by-pass passage for by-passing the cooling water led into the main coolant passage disposed in the cylinder head from the radiator core and leading it to the inlet portion of the water pump;

a heater circulating passage for circulating the cooling water led into the main coolant passage disposed in the cylinder head through an air-conditioning heater and leading it to the inlet portion of the water pump;

a thermostat valve for operatively opening or closing the radiator circulating passage or the by-pass passage in accordance with a variation of temperature of the cooling water; and at least either one of the by-pass passage and the heater circulating passage including a coolant return passage disposed in the cylinder block and extending in the direction of the cylinder alignment in the cylinder block over substantially the length or more than the length of the cylinders in the cylinder block.

2. The engine cooling structure according to claim 1, wherein both of the by-pass passage and the heater circulating passage have each a coolant return passage disposed in the cylinder block and positioned in parallel to each other.

3. The engine cooling structure according to claim 1, wherein the cylinder block is provided on its one end portion in the direction of the cylinder alignment with a hollow portion for mounting the thermostat valve, the thermostat valve mounting hollow portion has an opening on one side surface of the cylinder block, the thermostat valve is mounted in the thermostat valve mounting hollow portion, and the thermostat valve mounting hollow portion has an opening communicating with one end of the coolant return passage disposed in the cylinder block.

4. The engine cooling structure according to claim 3, wherein a water pump housing for receiving an impeller of the water pump is mounted on one side end portion of the cylinder block in the direction of the cylinder alignment adjacent the thermostat valve mounting hollow portion, and the water pump housing is communicated with the thermostat valve mounting hollow portion through a coolant passage disposed in the cylinder block.

5. The engine cooling structure according to claim 3, wherein the by-pass passage includes the coolant return passage disposed in the cylinder block, one end of the coolant return passage has an opening on the bottom of the thermostat valve mounting hollow portion so as to be opened or closed operatively by the thermostat valve mounted in the thermostat valve mounting hollow portion, and a valve casing for journaling the thermostat valve mounting hollow portion is connected to a radiator outlet passage in the radiator circulating passage led from the radiator core.

6. The engine cooling structure according to claim 1, wherein the water pump housing for receiving the impeller of the water pump is disposed on one end portion of the cylinder block in the direction of the cylinder alignment, the water pump housing has an opening on one end surface of the cylinder block in the direction of the cylinder alignment, and the water pump housing also has an opening communicating with one end of the coolant return passage disposed in the cylinder block.

7. The engine cooling structure according to claim 6, wherein the heater circulating passage include the return coolant passage disposed in the cylinder block and the return coolant passage is mounted virtually concentrically with the axis of the impeller mounted in the water pump housing.

8. The engine cooling structure according to claim 1, wherein the by-pass passage includes the coolant return passage disposed in the cylinder block, the coolant return passage is mounted on one side portion of the lower deck in the cylinder block, an oil passage for a lubricating oil is mounted on the other side portion in the lower deck therein, and the oil passage extends virtually symmetrically with the coolant return passage with respect to the center line of a cylinder bore and positioned in the direction of the cylinder alignment.

9. The engine cooling structure according to claim 1, wherein the by-pass passage includes the coolant return passage disposed in the cylinder block, and the cylinder block is provided with an oil return passage for returning a lubricating oil from a cam chamber in the cylinder head to an oil pan and the oil return passage is a arranged adjacent the coolant return passage disposed in the cylinder block.

* * * * *